United States Patent [19]

Miller

[11] 4,453,680

[45] Jun. 12, 1984

[54] STEEL TAPE RELOAD DISPENSER

[76] Inventor: Douglas N. Miller, 1137 Butte Dr., Santa Rosa, Calif. 95401

[21] Appl. No.: 277,849

[22] Filed: Jun. 26, 1981

[51] Int. Cl.[3] ..... B65H 75/16

[52] U.S. Cl. ..... 242/85; 242/55.53; 242/84.8; 242/106; 242/129; 33/138

[58] Field of Search ..... 242/84.8, 105, 85, 107, 242/106, 128, 129.5, 129, 132, 134, 136, 137, 146, 96, 84.1 R, 84.1 K, 55.53; 33/138

[56] References Cited

U.S. PATENT DOCUMENTS

| | | | |
|---|---|---|---|
| 1,575,619 | 3/1926 | Catucci | 242/84.1 K |
| 1,653,858 | 12/1927 | Kindler et al. | 242/107 |
| 2,170,186 | 8/1939 | Catron | 242/84.1 K |
| 3,122,334 | 2/1964 | Nebash | 242/55.53 |
| 3,721,395 | 3/1973 | Snipes | 242/134 X |
| 3,796,341 | 3/1974 | Berman | 242/55.53 |
| 3,973,741 | 8/1976 | Dean | 242/106 X |
| 3,979,833 | 9/1976 | Grundman | 242/84.8 X |
| 4,067,513 | 1/1978 | Rutty et al. | 242/84.8 X |

*Primary Examiner*—John M. Jillions
*Attorney, Agent, or Firm*—Melvin R. Stidham

[57] ABSTRACT

A steel tape reload dispenser comprising a cylinder cup which receives replacement tapes and has a number of pairs of gripping fingers extending from the side wall to grip the peripheral post on standard tape housings. A circular lid may be applied with either side up depending upon whether a long tape or a short tape is being installed. With the clips gripping adjacent posts of the standard housing, the repalcement tape is attached to the reel and wound from the reload dispenser.

4 Claims, 4 Drawing Figures

STEEL TAPE RELOAD DISPENSER

BACKGROUND OF THE INVENTION

There are many industrial operations wherein steel tape is used extensively and abusively to the extent that worn and broken tape frequently requires replacement. For example, in the lumber industry, when a tree is felled, the reel is held or anchored at one end of the tree and a worker moves rapidly to the other end of the tree to measure the length, often causing the steel tape to impact against or bend around tree branches, as well as rocks and other impediments on the ground. Replacement of the tape requires loosening of screws to remove the old tape and then inserting the new tape, fastening it to the reel and reeling it up, all while restraining it from becoming uncoiled. It is virtually impossible for all this to be done by one person.

OBJECTS OF THE INVENTION

It is an object of this invention to provide a steel tape reload dispenser which enables a single person to replace a steel tape on a standard tape housing.

It is a further object of this invention to provide a steel tape free load dispenser that can replace tapes on any one of a number of standard tape housings;

It is a further object of this invention to provide a steel tape reload dispenser that can readily be adapted for replacement of either 50 or 75 foot long tapes.

Other objects and advantages of this invention will become apparent from the description to follow, particularly when read in conjunction with the accompanying drawing.

SUMMARY OF THE INVENTION

In carrying out this invention, I provide a shallow cylindrical cup adapted to accommodate a coil replacement tape. There is a tape discharge opening in the side of the cup and a number of pairs of clothespin-like clips extend from the side to snap over a pair of peripheral posts on a standard tape housing. A circular lid has cylindrical extensions on each side, one extending full depth so that a 50 foot replacement tape is received within it and on the other side is a shallow extension wherein a 75 foot tape is nested within the cylindrical walls of the cup, but below the lid extension. With the clips secured to the post of the tape housing, the operator can secure the end of the tape to the reel and wind it up while the tape is in place within the reload dispenser.

DESCRIPTION OF A PREFERRED EMBODIMENT

Figure 1:
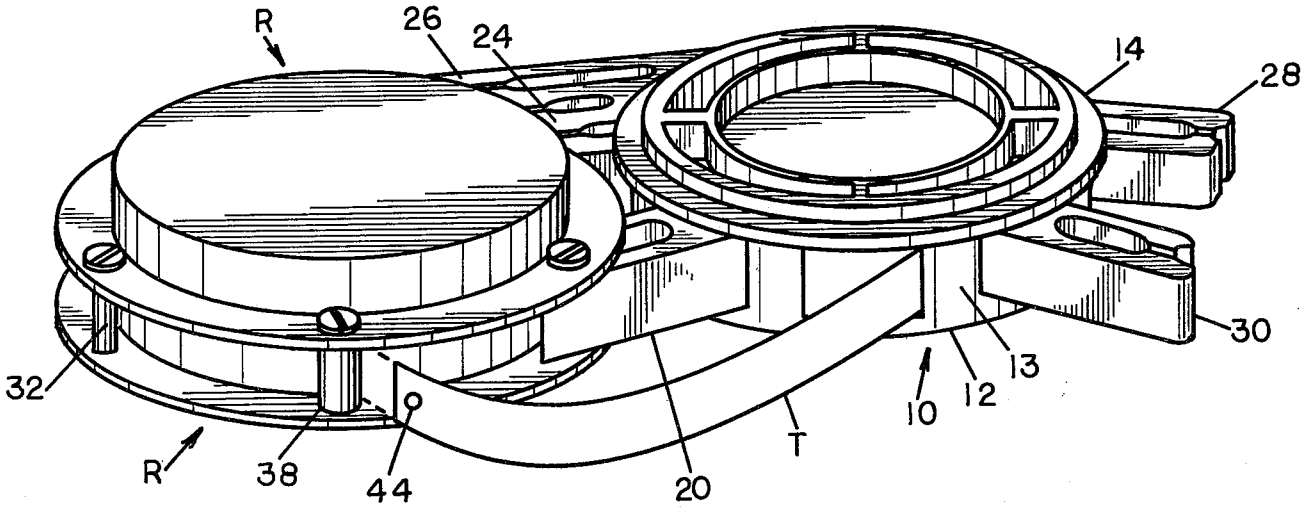
FIG. 1 is a view in perspective of the steel tape reload dispenser mounted on a standard tape housing.
Figure 2:
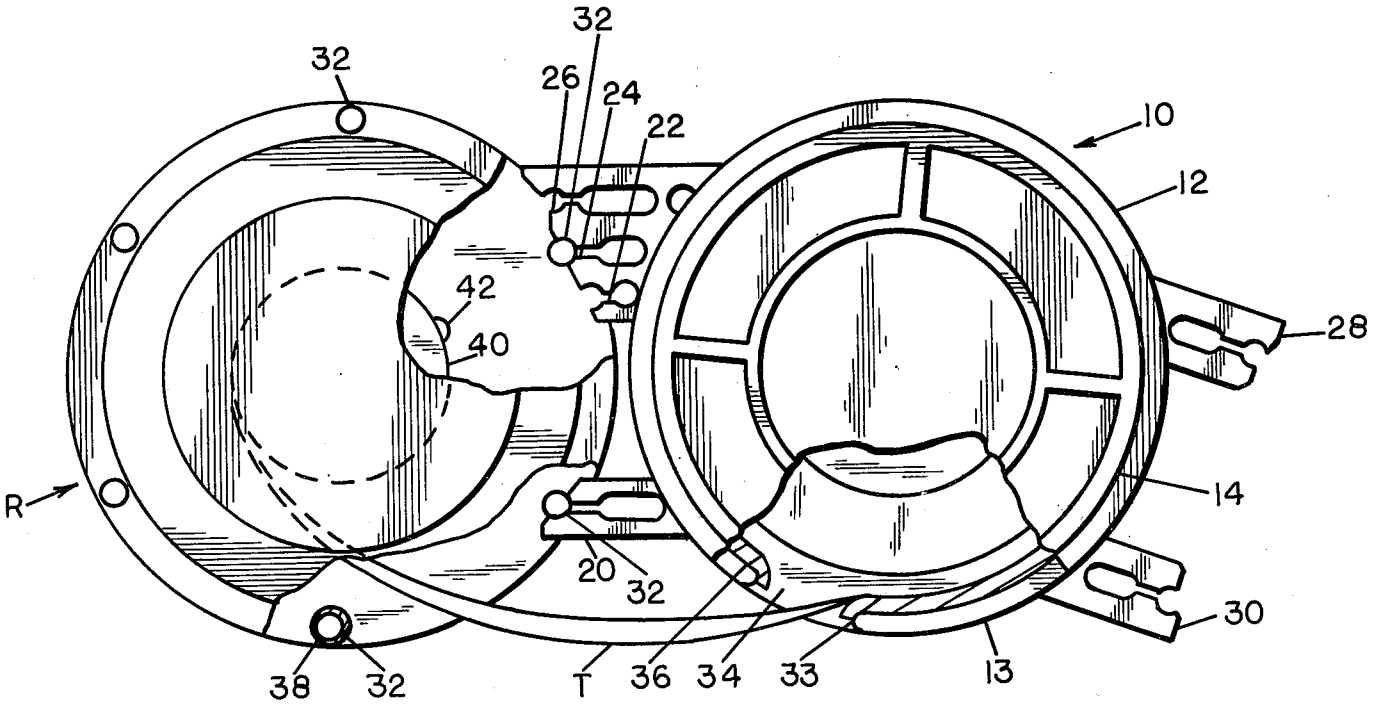
FIG. 2 is a top view of the reload dispenser partially broken away.
Figure 3:
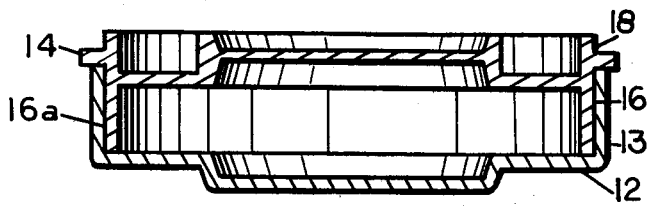
FIG. 3 is a section view of the dispenser as adapted to dispense a 50 foot roll of tape.
Figure 4:
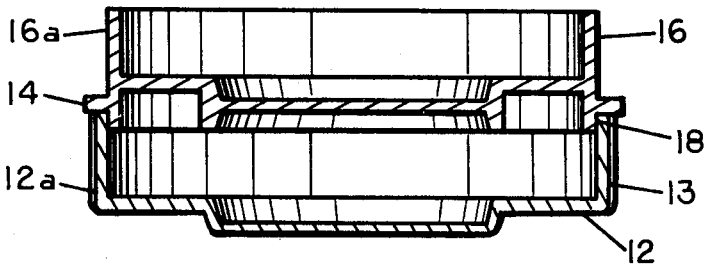
FIG. 4 is a vertical section view of the dispenser as adapted to dispense a 75 foot roll of tape.

Referring now to the drawings with greater particularity, the steel tape reload dispenser 10 of this invention comprises a shallow cup 12 with a cylindrical wall 13, and a circular lid 14, the latter having cylindrical extensions 16 and 18 on opposite sides thereof which nest into the cylindrical cup walls 13. When a 50 foot coil of tape is to be replaced, the full depth extension 16 (FIG. 3) is inserted into the cup 12 so that the outer diameter of the coil will be contained within the inner surface **16*a* of the cylindrical extension 16. When a 75 foot coil of tape is to be replaced, the lid 14 is inverted so that the shallow cylindrical extension 18 is received within the cup 12, whereby the coil of tape can be contained within the larger diameter inner surface 12*a* of the cup itself and below the short extension 18**.

Extending laterally from the cylindrical wall 13 of the cup 12 are a plurality of clothespin-like fingers 20, 22, 24, 26, 28 and 30. These clips are positioned to snap over selected pairs of the peripheral posts 32 of a standard tape housing. For example, the clips 20 and 24 are located to snap over two adjacent posts 32 on the 50 foot reel housing R of one manufacturer; the clips 20 and 22 snap over adjacent posts on a 50 foot reel housing of another manufacturer; and the clips 20 and 26 snap over the adjacent posts on a 75 foot reel housing of still another manufacturer. The clips 28 and 30 are adapted for the adjacent post of another known 50 foot reel housing.

A tape discharge opening 34 is provided in the cylindrical wall 13 of the cup 12, and in the full depth cylindrical extension 16 on the lid 14, a similar opening 34 is provided. Lips 36 on both sides of the opening 34 interlock with the edges 33 of the opening 34 to hold the lid 14 against relative rotation within the cup 12.

In use, the old tape is removed from the tape housing R. The replacement tape T is placed within the cup 12, with the appropriate cylindrical extensions 16 or 18 inserted into the cup, depending upon the length of tape to be used. Then, a short length of tape is extended from the dispenser 10 and appropriate clips, e.g. the clips 20 and 24, are snapped over the appropriate adjacent posts 32 of the tape housing R, the particular posts to be used being those adjacent to the plastic roller 38, which is carried on one of the posts 32. Now, holding the entire assembly, tape housing R and dispenser 10, in one hand, the replacement tape T is inserted between the plastic roller 38 and the adjacent finger 20 and is secured to the reel 40 by inserting a screw 42 carried on the reel through the hole 44, conventionally provided in the end of the tape T and then tightening the screw. Then, with the entire assembly still held in one hand, the other hand is used to wind the reel until the conventional spring therein becomes sufficiently taut to pull the tape T fully onto the reel R. Finally, the tape is pulled free, as necessary, from the dispenser 10 and the dispenser 10 is disengaged from the reel R.

While this invention has been described in connection with a preferred embodiment thereof, it is obvious that modifications and changes therein may be made by those skilled in the art to which it pertains, without departing from the spirit and scope of this invention as defined by the claims appended hereto.

What is claimed as invention is:

1. A steel tape reload dispenser for reloading a standard tape housing having a pair of generally circular, parallel side walls interconnected by posts around the peripheries thereof comprising:

a cylindrical cup to receive a replacement tape;

at least one pair of circumferentially spaced clothespin-like clips extending from the cylindrical wall of said cup to grip adjacent peripheral posts on a standard tape housing so that said cup and housing are interconnected juxtaposed with axes parallel; and a tape discharge opening in the side of said cup.

2. The steel tape reload dispenser defined by claim 1 including:

a circular lid for said cup; and a cylindrical extension on the base of said lid to be snugly received within said cup.

3. The steel tape reload dispenser defined by claim 2 wherein:

there are two cylindrical extensions on the lid of said cup on opposite sides thereof;

one of said extensions being shallow to enable a long tape to fit within said cup below said shallow extension, and the other extension being full depth to receive a shorter tape within the inner wall thereof: and including a complementary tape discharge opening in said full depth cylindrical extension.

4. The steel tape reload dispenser defined by claim 1 wherein:

there are a plurality of pairs of clothespin-like clips extending from the cylindrical side of said cup to grip pairs of peripheral posts on any one of a number of standard tape housings.

* * * * *